US007621327B2

(12) United States Patent
Bane

(10) Patent No.: US 7,621,327 B2
(45) Date of Patent: Nov. 24, 2009

(54) DOWNHOLE SEAL BORE REPAIR DEVICE

(75) Inventor: Darren E. Bane, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 121 days.

(21) Appl. No.: 11/930,651

(22) Filed: Oct. 31, 2007

(65) Prior Publication Data

US 2009/0107670 A1 Apr. 30, 2009

(51) Int. Cl.
*E21B 29/10* (2006.01)

(52) U.S. Cl. ..... 166/277; 166/170

(58) Field of Classification Search ..... 166/277, 166/170, 173, 902

See application file for complete search history.

(56) References Cited

U.S. PATENT DOCUMENTS

| | | | | |
|---|---|---|---|---|
| 2,280,769 | A | 4/1942 | Page | |
| 4,299,282 | A * | 11/1981 | Thornton | 166/177.3 |
| 4,455,789 | A | 6/1984 | Gehring | |
| 4,482,014 | A | 11/1984 | Allwin | |
| 4,542,797 | A | 9/1985 | Garrett | |
| 4,706,748 | A * | 11/1987 | Harris | 166/173 |
| 5,009,265 | A | 4/1991 | Bailey et al. | |
| 5,027,895 | A | 7/1991 | Barton | |
| 5,351,758 | A | 10/1994 | Henderson et al. | |
| 5,743,335 | A | 4/1998 | Bussear | |
| 5,884,700 | A * | 3/1999 | Cook et al. | 166/153 |
| 6,439,313 | B1 | 8/2002 | Thomeer et al. | |
| 6,523,615 | B2 * | 2/2003 | Gandy et al. | 166/381 |
| 6,561,269 | B1 * | 5/2003 | Brown et al. | 166/77.1 |
| 6,679,328 | B2 | 1/2004 | Davis et al. | |
| 6,910,537 | B2 | 6/2005 | Brown et al. | |
| 6,976,541 | B2 | 12/2005 | Brisco et al. | |
| 2004/0112609 | A1 | 6/2004 | Whanger et al. | |

FOREIGN PATENT DOCUMENTS

| | | | |
|---|---|---|---|
| EP | 0549821 | B1 | 7/1995 |
| JP | 07252986 | A | 10/1995 |

OTHER PUBLICATIONS

Storaune, Anders, et al., "Versatile Expandables Technology for Casing Repair", SPE/IADC 92330, Feb. 2005, 1-8.

McInally, Gerald, et al., "Scale Milling and Nipple Profile Recovery with Electrical Wireline—Case Histories from Successful Operations in the North Sea", SPE 110322, Nov. 2007.

Millard II, Robert L, "New Fiberglass Liner Completion Technique Salvages Old Injection Wells", SPE 17290, Mar. 1988, 1-4.

* cited by examiner

*Primary Examiner*—Kenneth Thompson
*Assistant Examiner*—James G Sayre
(74) *Attorney, Agent, or Firm*—Steve Rosenblatt

(57) ABSTRACT

A tool is preferably landed in a downhole profile commonly found adjacent to seal bores. Once landed, preferably with coiled tubing, pressure in the coiled tubing triggers a switch to power a motor to rotate a polishing cylinder that features spirally wound vanes. A reservoir of resin or other repair material is connected to an injection pump to deliver the material as the vanes are rotating. The material exits between the vanes so that the vanes can spread it and work it into surface irregularities. After the material is sufficiently spread into voids and the requisite polishing completed, the seal bore is again ready to accept a tool in a sealed relationship.

18 Claims, 1 Drawing Sheet

DOWNHOLE SEAL BORE REPAIR DEVICE

FIELD OF THE INVENTION

The field of the invention is repair of damaged existing seal bores in downhole assemblies without removal of the string from the wellbore.

BACKGROUND OF THE INVENTION

Seal bores are frequently used downhole to isolate zones or to facilitate the operation of accessory or auxiliary equipment. They can be accessed by a tool on a string that is placed into position by means of wireline services or coiled tubing. The tool can have external seals that interact with the seal bore to get a fluid tight seal. Thereafter, other tools can be passed through the seal bore or fluids that have erosive characteristics. Over time, there can be damage from these activities to the surface of the seal bore. In the past this has required pulling the string that includes the seal bore or taking other measures that decrease drift diameter by inserting another bore within the existing bore or decreasing pressure rating of the tubular by simply machining a larger bore at the location of the original bore.

Illustrative of techniques for creating a seal bore downhole are US Application 2004/0112609 and U.S. Pat. No. 6,523,615. U.S. Pat. No. 5,351,758 illustrates adhering strips of material to the well interior and of general interest to this field are U.S. Pat. Nos. 6,910,537; 5,009,265; 6,679,328; 4,542,797; 4,482,014; 6,439,313; 4,455,789; 5,743,335; 2,280,769; 5,351,758; JP 07252986 and EP 0549821.

The present invention allows repair of damaged seal bores in place. It fills in voids or cracks and polishes them to the requisite tolerance so that a troublesome or leaking seal bore can again be serviceable without removal from the well. These and other features of the present invention will become more clear to those skilled in the art from a review of the detailed description and the associated drawings while recognizing that the full scope of the invention is in the appended claims.

SUMMARY OF THE INVENTION

A tool is preferably landed in a downhole profile commonly found adjacent to seal bores. Once landed, preferably with coiled tubing, pressure in the coiled tubing triggers a switch to power a motor to rotate a polishing cylinder that features spirally wound vanes. A reservoir of resin or other repair material is connected to an injection pump to deliver the material as the vanes are rotating. The material exits between the vanes so that the vanes can spread it and work it into surface irregularities. After the material is sufficiently spread into voids and the requisite polishing completed, the seal bore is again ready to accept a tool in a sealed relationship.

DETAILED DESCRIPTION OF THE PREFERRED EMBODIMENT

Figure 1:
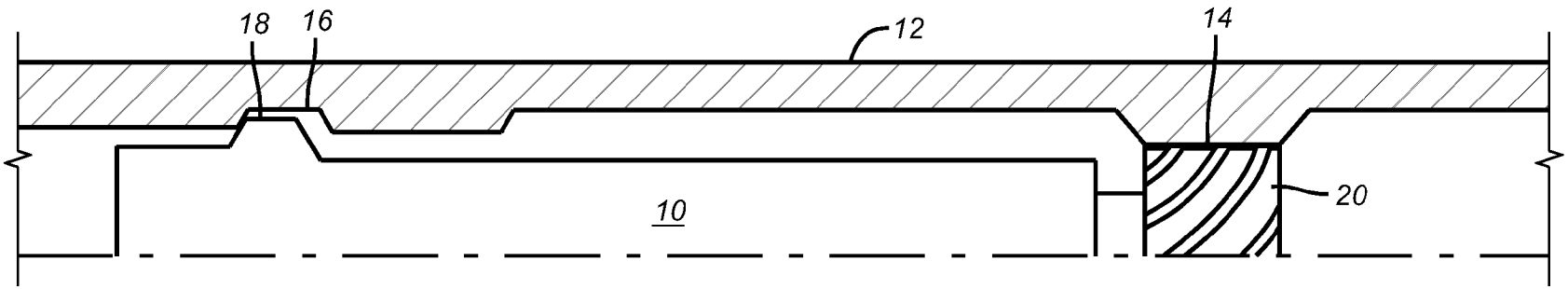
FIG. 1 is a section view of the tool landed in a seal bore and ready to repair it.

The tool 10 is preferably conveyed into tubing 12 that has a seal bore 14 and a locator groove 16 nearby. The tool 10 has a latch, or locking device, 18 to find support in the groove 16 so that the head 20 will line up with the seal bore 14. Seal bore 14 is damaged and the objective of the tool 10 is to make it again serviceable without removing the tubing 12.

Figure 2:
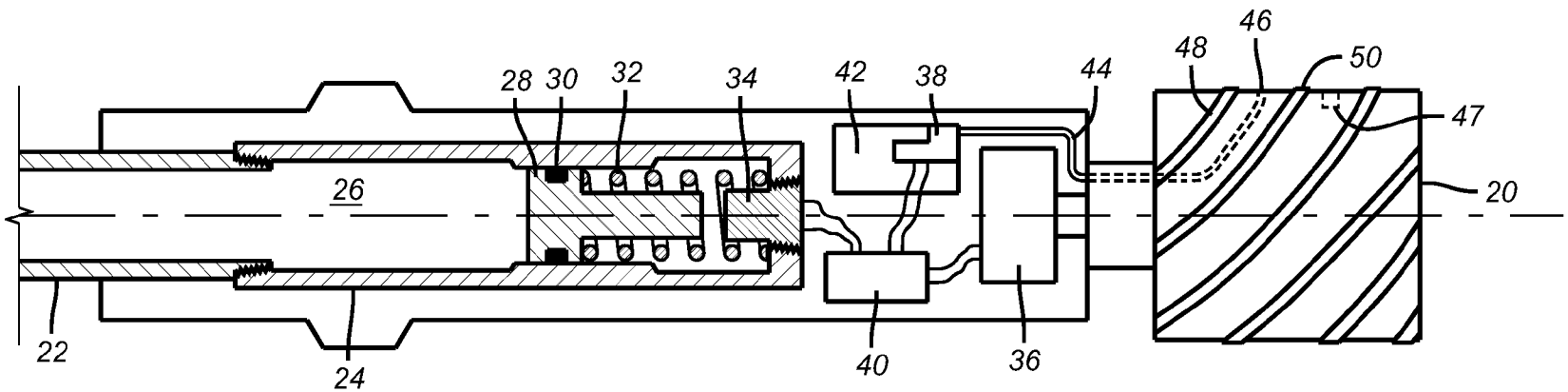
FIG. 2 is the view of FIG. 1 showing the internal components of the preferred embodiment.

Referring now to FIG. 2, coiled tubing 22 supports the body 24 of the tool 10. Passage 26 is sealed by piston 28 that has an external seal 30. When pressure builds on piston 28 it moves against the bias of spring 32 to make contact with a switch or sensor 34 that can complete a circuit to power up drum motor 36 and repair fluid pump 38 from power supply 40. A reservoir 42 supplies pump 38 that then delivers fluid through lines such as 44 through swivel joints (not shown) into outlets 46 between spiral vanes such as 48 and 50 on drum 20. The rotation of the drum 20 while repair fluid comes out of outlets 46 helps to spread the fluid across the seal bore 14 due to the spiral orientation of the vanes 48 and 50. Apart from spreading the repair fluid into voids or cracks in the seal bore 14 the vanes work the fluid into the cracks or voids and then polish the bore to the required consistency so that it will seal when a tool is reinserted into it with external seals.

There are options to vary the preferred embodiment. The repair fluid can be injected with pressure developed from moving piston 28. Motor 36 can be a fluid motor rather than being operated by a local 12 volt power supply. Power can be delivered through an umbilical rather than a local power supply. Power can come from a hydraulic control line. Signals can come from the surface through a control line, a fiber optic line or an electric line for example. The vanes such as 46 and 48 can be at varied spacing, parallel or askew to each other and spiral around less than one time to a number of times around the drum 20. The outlets 46 can be a singular outlet or multiple outlets generally aligned with an adjacent vane. Controls can allow drum 20 to rotate for a given time before injection starts from outlets 46. Drum 20 can also be fitted with light and a camera, shown schematically as 47, to transmit a view of the seal bore 14 either through the drum 20 or mounted just above or below it. Sensors, also shown schematically as 47, can be mounted to the drum 20 to measure surface irregularity to provide surface feedback that the seal bore is serviceable to seal against a downhole tool. Known materials such an epoxy resin or liquid metal are contemplated to be applied to the seal bore 14 to fill the voids and fissures in it.

The above description is illustrative of the preferred embodiment and many modifications may be made by those skilled in the art without departing from the invention whose scope is to be determined from the literal and equivalent scope of the claims below.

I claim:

1. A method of repair of polished surfaces downhole for subsequent service as a sealing surface, comprising:

anchoring a tool with a polishing head at a predetermined downhole location;

positioning said tool, with a rotating polishing head, at a polished surface;

spreading a fill material against the polished surface;

working the fill material into voids in the polished surface with said polishing head: and sealing against the polished surface.

2. The method of claim 1, comprising:

delivering said fill material through said polishing head.

3. The method of claim 2, comprising:

providing a plurality of vanes on said polishing head.

4. The method of claim 3, comprising:

delivering said fill material between said vanes.

5. The method of claim 4, comprising:

winding said vanes spirally around said polishing head.

6. The method of claim 5, comprising:

delivering said tool on coiled tubing;

using pressure in said coiled tubing to trigger operation of said polishing head and delivery of said fill material.

7. The method of claim 6, comprising:

using pressure in said coiled tubing to trigger an electrical switch to activate a drive motor for said polishing head and a drive motor for a pump to deliver fill material.

8. The method of claim 7, comprising:

monitoring the surface condition of the polished surface;

transmitting surface condition data to the well surface from said tool.

9. The method of claim 8, comprising:

supporting the tool in a profile in a surrounding tubular adjacent the polished surface.

10. A method of repair of polished surfaces downhole, comprising:

positioning a tool with a polishing head at the polished surface;

spreading a fill material against the polished surface;

working the fill material into voids in the polished surface with said polishing head;

monitoring the surface condition of the polished surface;

transmitting surface condition data to the well surface from said tool.

11. A tool for repair of polished surfaces downhole, comprising:

a body having a polishing head, said body adapted to be supported adjacent a polished surface so as to align said polishing head with the polished surface;

a fill material delivery system on said body for initially storing fill material and subsequently selectively delivering said stored fill material to the polished surface while said polishing head is disposed adjacent said polished surface to work the fill material into voids in the polished surface.

12. A tool for repair of polished surfaces downhole, comprising:

a body having a polishing head, said body adapted to be supported adjacent a polished surface so as to align said polishing head with the polished surface;

a fill material delivery system on said body for selectively delivering fill material to the polished surface while said polishing head is disposed adjacent said polished surface;

said delivery system delivers the fill material to the periphery of said polishing head.

13. The tool of claim 12, wherein:

said polishing head comprises vanes and said delivery system delivers the fill material between said vanes.

14. The tool of claim 13, wherein:

said vanes wrap spirally around a cylindrically shaped polishing head.

15. The tool of claim 14, wherein:

said polishing head and delivery system are driven by a power supply in said body.

16. The tool of claim 14, wherein:

said polishing head and delivery system are driven by power supplied from outside said body.

17. The tool of claim 14, wherein:

said body further comprises a sensor to monitor condition of the polished surface and a capacity to send data outside said body.

18. The tool of claim 17, wherein:

said sensor is mounted to said polishing head.

* * * * *